US007997388B2

(12) United States Patent
Nieboer et al.

(10) Patent No.: US 7,997,388 B2
(45) Date of Patent: Aug. 16, 2011

(54) DETECTION PLATFORMS

(75) Inventors: Christopher J. Nieboer, Marietta, GA (US); Josh H. Strange, Smyrna, GA (US); Brandon T. Harbuck, Hampton, GA (US)

(73) Assignee: ICx Tactical Platforms Corp., Forest Park, GA (US)

( * ) Notice: Subject to any disclaimer, the term of this patent is extended or adjusted under 35 U.S.C. 154(b) by 452 days.

(21) Appl. No.: 12/103,084

(22) Filed: Apr. 15, 2008

(65) Prior Publication Data

US 2009/0255763 A1 Oct. 15, 2009

(51) Int. Cl.
*B66F 9/06* (2006.01)

(52) U.S. Cl. ..... 187/222; 187/250; 187/276; 187/277; 52/118

(58) Field of Classification Search ..... 187/222, 187/250, 276, 277; 52/118
See application file for complete search history.

(56) References Cited

U.S. PATENT DOCUMENTS

| | | | | |
|---|---|---|---|---|
| 3,709,322 | A | 1/1973 | Mitchell | |
| 3,865,265 | A * | 2/1975 | Brudi et al. | 414/635 |
| 4,356,638 | A * | 11/1982 | McKenna et al. | 33/333 |
| 4,518,990 | A * | 5/1985 | Gilvydis | 348/39 |
| 4,815,757 | A * | 3/1989 | Hamilton | 280/764.1 |
| 5,615,855 | A * | 4/1997 | Marue et al. | 248/405 |
| 5,720,069 | A * | 2/1998 | Wanner et al. | 15/53.1 |
| 5,833,762 | A * | 11/1998 | Wanner et al. | 134/18 |
| 6,299,336 | B1 * | 10/2001 | Hulse | 362/526 |
| 6,829,835 | B2 * | 12/2004 | Pfeil | 33/333 |
| 7,349,025 | B2 * | 3/2008 | Wong | 348/373 |
| 7,429,139 | B2 * | 9/2008 | Wesselink et al. | 396/427 |
| 2004/0052627 | A1 * | 3/2004 | Rau et al. | 414/699 |
| 2004/0208499 | A1 | 10/2004 | Grober | |
| 2005/0163565 | A1 * | 7/2005 | Quenzi et al. | 404/84.1 |
| 2005/0241885 | A1 * | 11/2005 | Burgess et al. | 187/297 |
| 2006/0119701 | A1 * | 6/2006 | King | 348/14.08 |
| 2007/0109404 | A1 * | 5/2007 | Lortie | 348/85 |
| 2007/0224025 | A1 * | 9/2007 | Ablabutyan et al. | 414/546 |
| 2008/0061211 | A1 | 3/2008 | Madsen | |
| 2008/0250727 | A1 * | 10/2008 | Hall et al. | 52/123.1 |
| 2009/0033045 | A1 * | 2/2009 | Clemens et al. | 280/6.15 |
| 2010/0181768 | A1 * | 7/2010 | Lavaur et al. | 290/44 |
| 2010/0250003 | A1 * | 9/2010 | Nieboer et al. | 700/275 |

FOREIGN PATENT DOCUMENTS

| | | |
|---|---|---|
| FR | 2867615 A1 | 9/2005 |
| FR | 2904480 A1 | 2/2008 |

OTHER PUBLICATIONS

International Search Report and Written Opinion, PCT Application No. PCT/US09/040656, mailed Dec. 15, 2010.

* cited by examiner

*Primary Examiner* — Walter Benson
*Assistant Examiner* — Kawing Chan
(74) *Attorney, Agent, or Firm* — McAfee & Taft

(57) ABSTRACT

Platforms for detecting, identifying and/or designating objects. Platforms according to one embodiment of the invention include an extendable mast connected to a skid via a linkage that allows pivoting of the mast with respect to the skid, and preferably does not permit rotation of the mast; at least two actuators connected to the mast; at least one inclination sensor; at least one detection sensor connected to the mast for detecting presence of an object; and circuitry that receives information from the inclination sensors and plumbs the mast. Coupling and actuator mechanisms are disclosed for connecting the mast to the skid in a manner that allows the mast to be stable for accurate use of the sensors, yet easily and quickly deployable for such use, whether the platform is deployed from the bed of a truck or when the skid is on the ground and the mast is fully extended.

16 Claims, 8 Drawing Sheets

DETECTION PLATFORMS

This invention relates generally to platforms with masts that support sensors for detecting, identifying and/or designating objects.

BACKGROUND

Platforms that include masts for various purposes are well known and ubiquitous. For instance, the Will-Burt Company of Orrville, Ohio markets a number of easily deployable pneumatic and other telescoping masts for commercial, military, night scan, mobile command, dockside utility, and A.C. Field detection applications. Masts and lifts that employ telescopically extending adjacent sections rather than concentric sections such as masts sold under the "GENIE" mark are marketed by, among others, Genie Industries of Redmond, Wash. and JLG Industries, Inc. of McConnellsburg, Pa.

Recent advances in sensing and imaging technology accompany availability of deployable masts. Ground tracking radar, infrared and other thermal or optical, laser and other sensor, identification, imaging and designation units and systems have become more compact, portable, robust and reliable, and less expensive, thereby becoming more suitable for deployable mast-mounted applications for detection, identification and/or designation of objects and other purposes.

A third area of technology advance that converges with changes in the mast and sensors/imagers fields is the communications area where mesh Ethernet, internet protocol and other wireless networks and other networks are now possible to network equipment over reasonably long distances to enhance communications and provide better command and control of distributed sensors, detectors, and other equipment.

At the same time, surveillance, monitoring, and observation requirements are growing, particularly along borders, in conflict zones, or other perimeters that must be patrolled and/or controlled.

SUMMARY

According to certain embodiments of the invention, there is provided a detection platform comprising:

a. an extendable mast connected to a skid via a linkage that allows pivoting of the mast with respect to the skid, and does not permit rotation of the mast;

b. at least two actuators connected to the mast;

c. at least one inclination sensor;

d. at least one detection sensor connected to the mast for detecting presence of an object; and e. circuitry that receives information from the inclination sensors and automatically controls the actuators to orient the mast substantially vertically.

The mast is preferably an extendable material lift which is adapted to bear a load of several hundred pounds. The mast also preferably has adjacent extending sections rather than concentric sections. Among other things, the adjacent sections can allow mounting of brackets or other structure for bearing the sensors without substantially increasing the overall height profile of the mast in stowed position. Preferably, the mast is constrained not to rotate.

The mast is preferably connected to the skid so that its weight is borne by a universal joint or other coupling mechanism that preferably does not allow rotation of the mast relative to the skid. The coupling mechanism is robust, and it allows the mast to be pivoted relative to the skid by the actuators but without undue play, even in a stiff wind or when subject to other stress or forces.

The mast is also coupled to the skid or intervening structure using two or more actuators. Preferably, the actuators are oriented at 90 degrees relative to each other and substantially horizontally relative to the skid. Such an orientation assists in stability and simplifies the geometry of controlling the mast orientation; however, any number of actuators at any desired angles relative to each other or the mast could be used. The actuators are preferably ball screw mechanisms which can be used to pivot the mast relative to the skid for automatic or manual plumbing. The actuators can also, if desired, be hydraulic or of other construction.

The skid is preferably of a type and size that allows together with the platform to be stowed in a pickup truck bed or other desirable location.

The mast preferably features in its top-most extending section, an acme screw or other extension mechanism for extending the sensors to an elevation that allows their use from the back of a pickup truck or other vehicle, without necessarily extending the mast to its full vertical extension.

The platform according to this embodiment also includes one or more sensors such as inclinometers, preferably connected to the mast, for sending information regarding inclination or orientation of the mast in multiple degrees of freedom. Output from the sensors is preferably employed by control circuitry to control the actuators for manual or automatic plumbing of the mast. Output from the sensors can drive visual indicators so that the mast can be plumbed manually by controlling the actuators manually in accordance with readings on the visual indicators.

One or more brackets preferably connects to the mast or the acme screw mechanism connected to the mast for bearing one or more sensors. In one embodiment, sensors can include a ground-detecting radar, infrared and/or other optical sensors, laser detection and/or indication units, audio sensors, rf spectrum sensors and other sensors as desired. According to one embodiment, the signals from the ground-detecting radar can automatically be employed to slew or train the infrared or optical detector to a target sensed by the radar. Images and/or other data from the radar and/or optical sensors can be conveyed via wireless or other network to a command center, or can be monitored at the platform, to identify and/or classify the object and, if desired, designate the object with a laser or other detector which can operate in a visual or non-visual wave length.

Stability of the mast, even in a strong wind, is necessary to allow the sensors and, if used, designators to remain trained on the object. This consideration gives rise to the universal joint and/or other robust connection of the mast to the skid, and preferably, the non-rotation of the mast relative to the skid or portions of itself. At the same time verticality of the mast is preferably accurately controlled so that the sensors and detectors can accurately be controlled and aimed through a full range of 360 degrees.

The platform preferably contains a stand-alone power supply such as a diesel or gasoline reciprocating engine with alternator or generator and/or batteries, solar or any other desired power supply. Power can also be supplied externally.

Certain embodiments of the platforms can also include GPS circuitry for automatically sensing and reporting geographical position of the platform so that nodes in a wireless network formed of such platforms can be coordinated precisely to other mapping of the geographical terrain for triangulation and thus establishing a geographical position of detected objects or otherwise.

BRIEF DESCRIPTION

DETAILED DESCRIPTION

Figure 1:
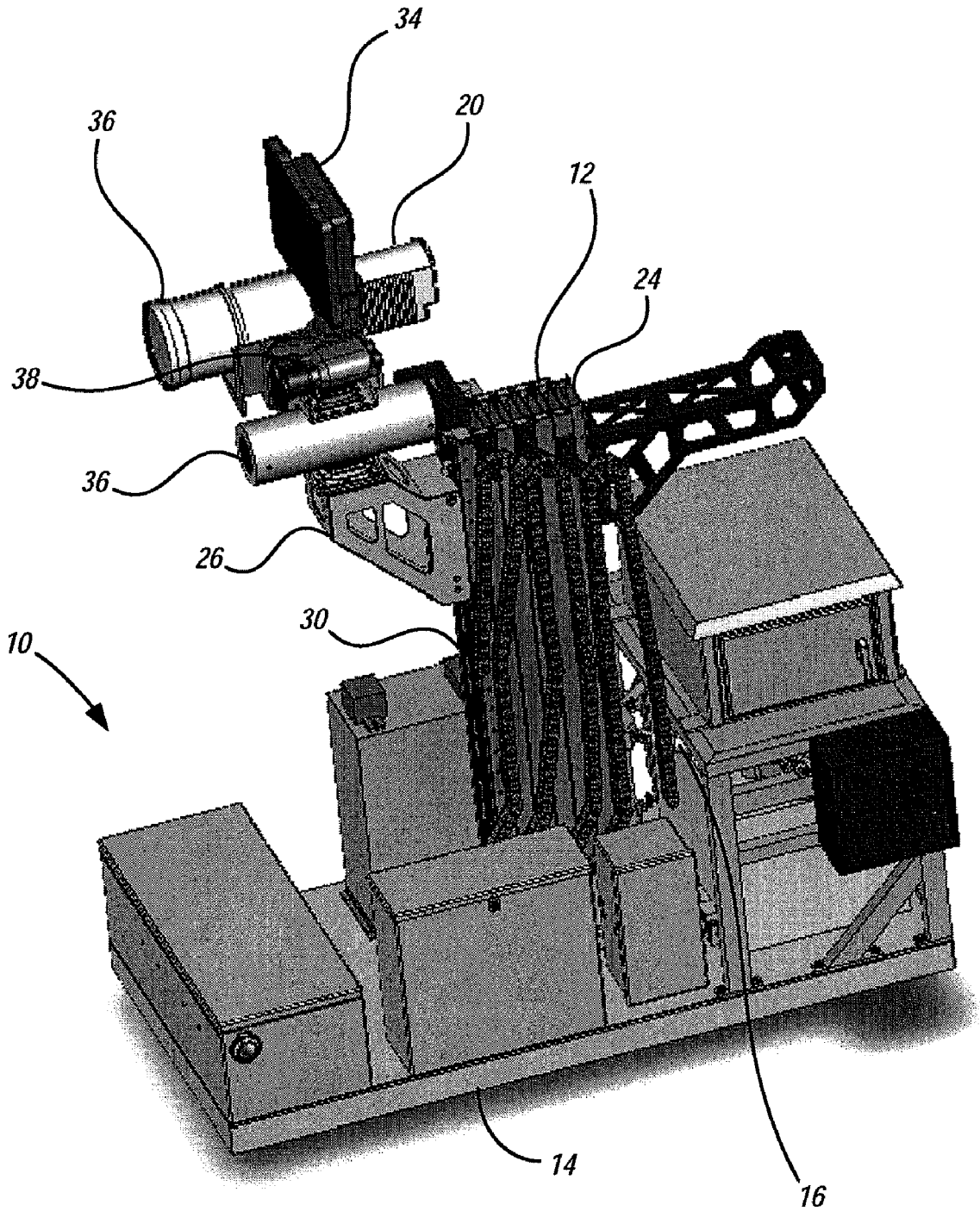
FIG. 1 is a perspective view of a platform according to one embodiment of the invention.
Figure 2:
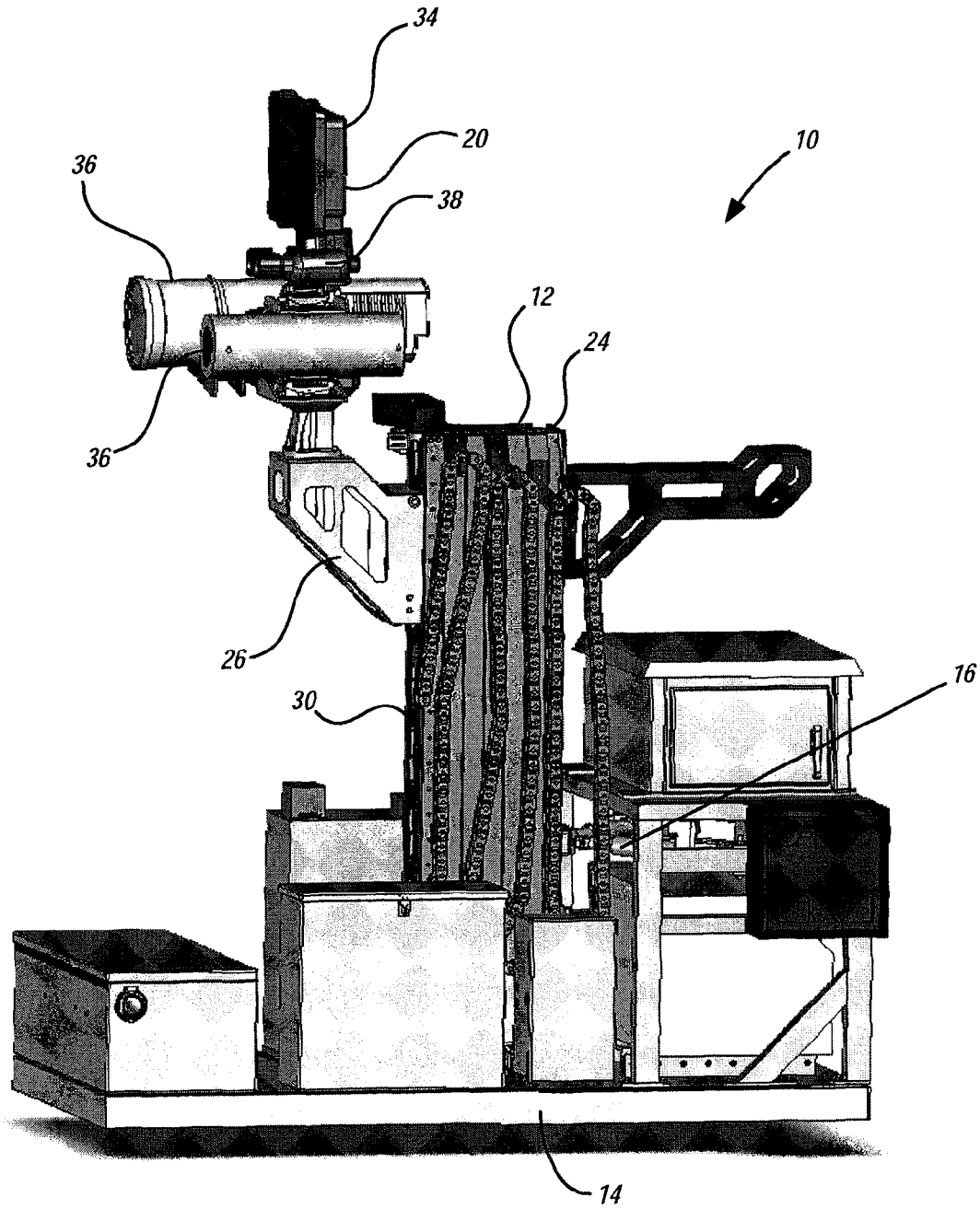
FIG. 2 is a side perspective view of the platform of FIG. 1.
Figure 3:
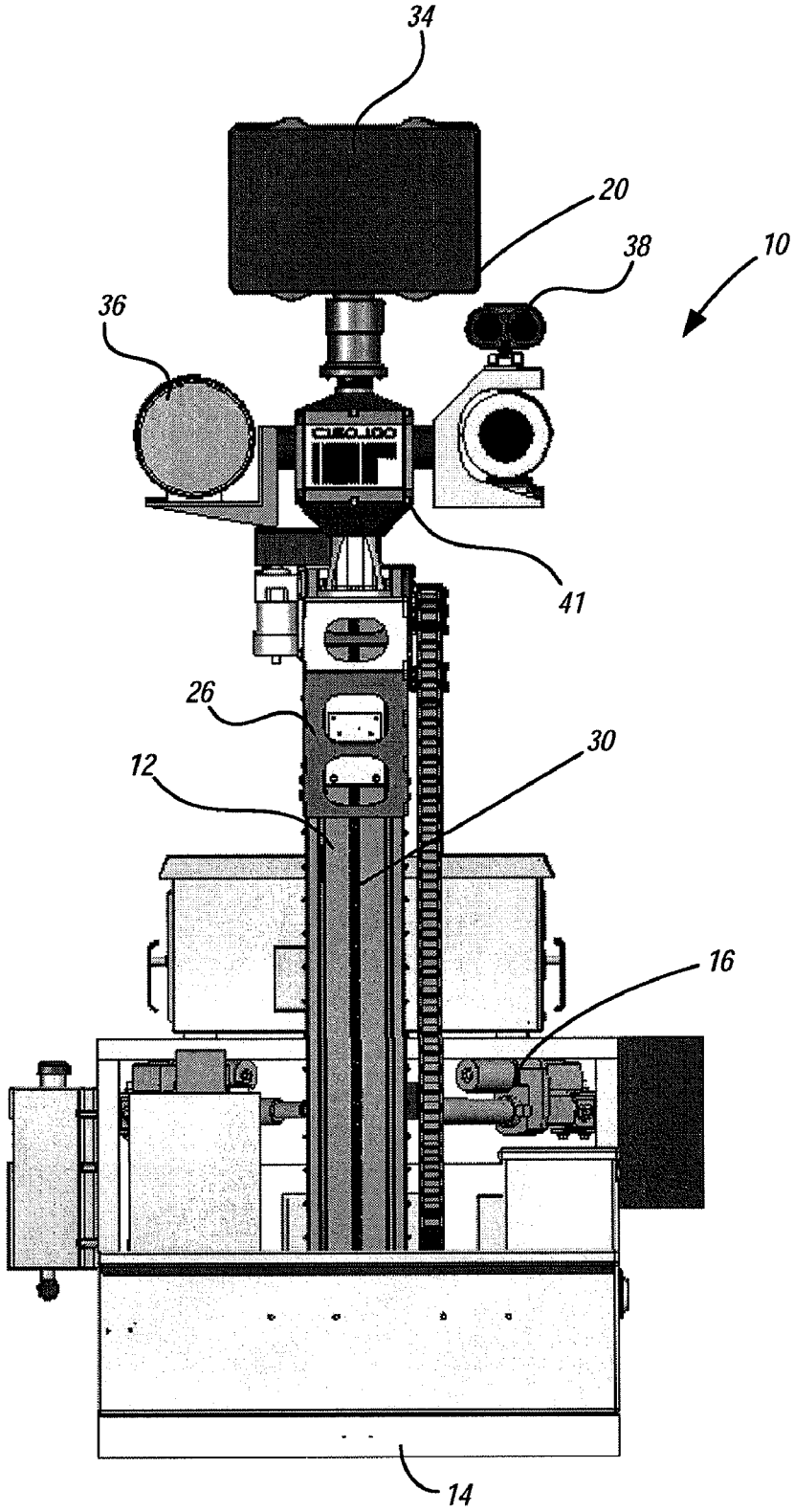
FIG. 3 is an end view of the platform of FIG. 1.
Figure 4:
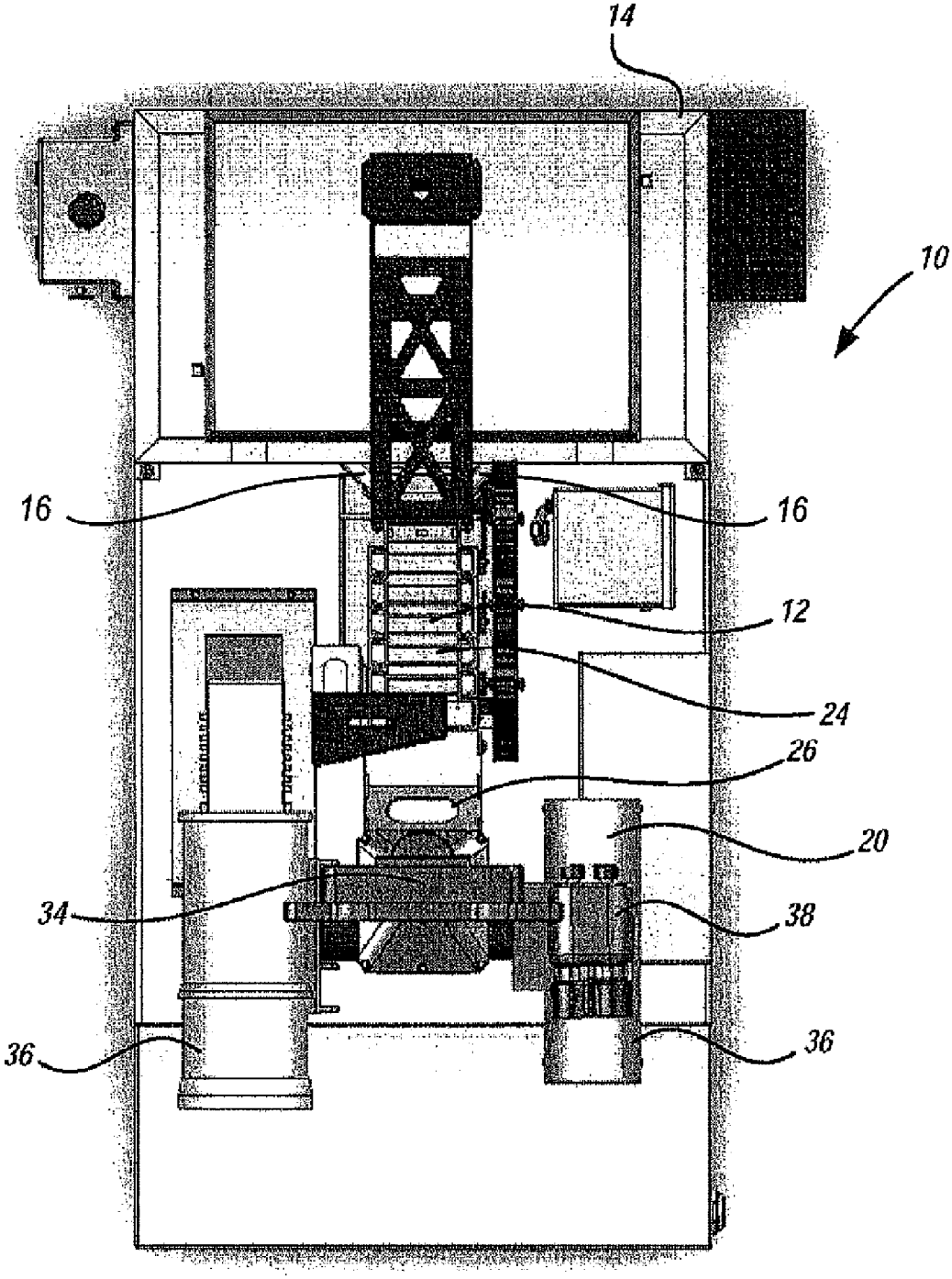
FIG. 4 is a top plan view of the platform of FIG. 1.
Figure 5:
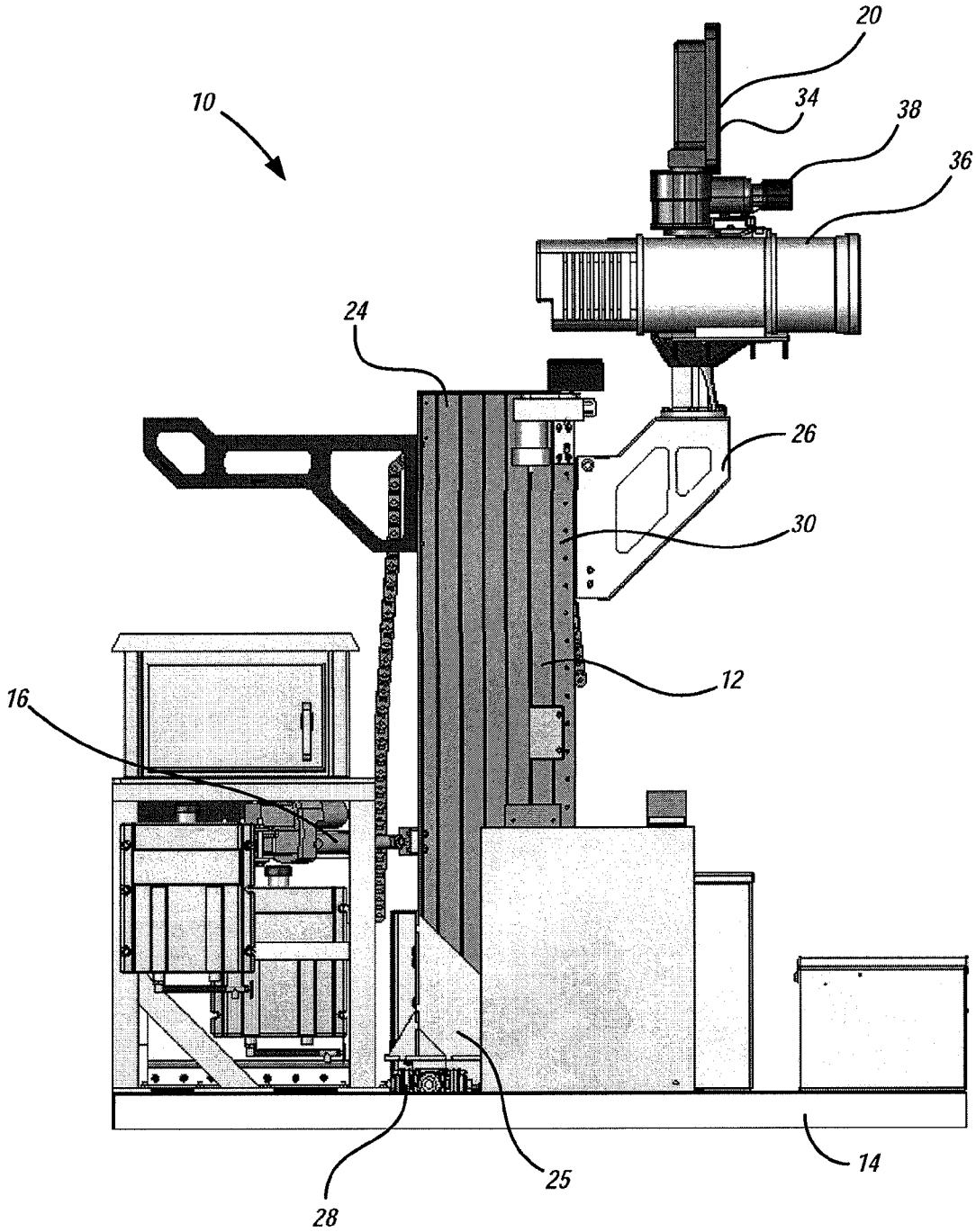
FIG. 5 is a side elevational view of the platform of FIG. 1 showing the U-joint and mast actuators.
Figure 6:
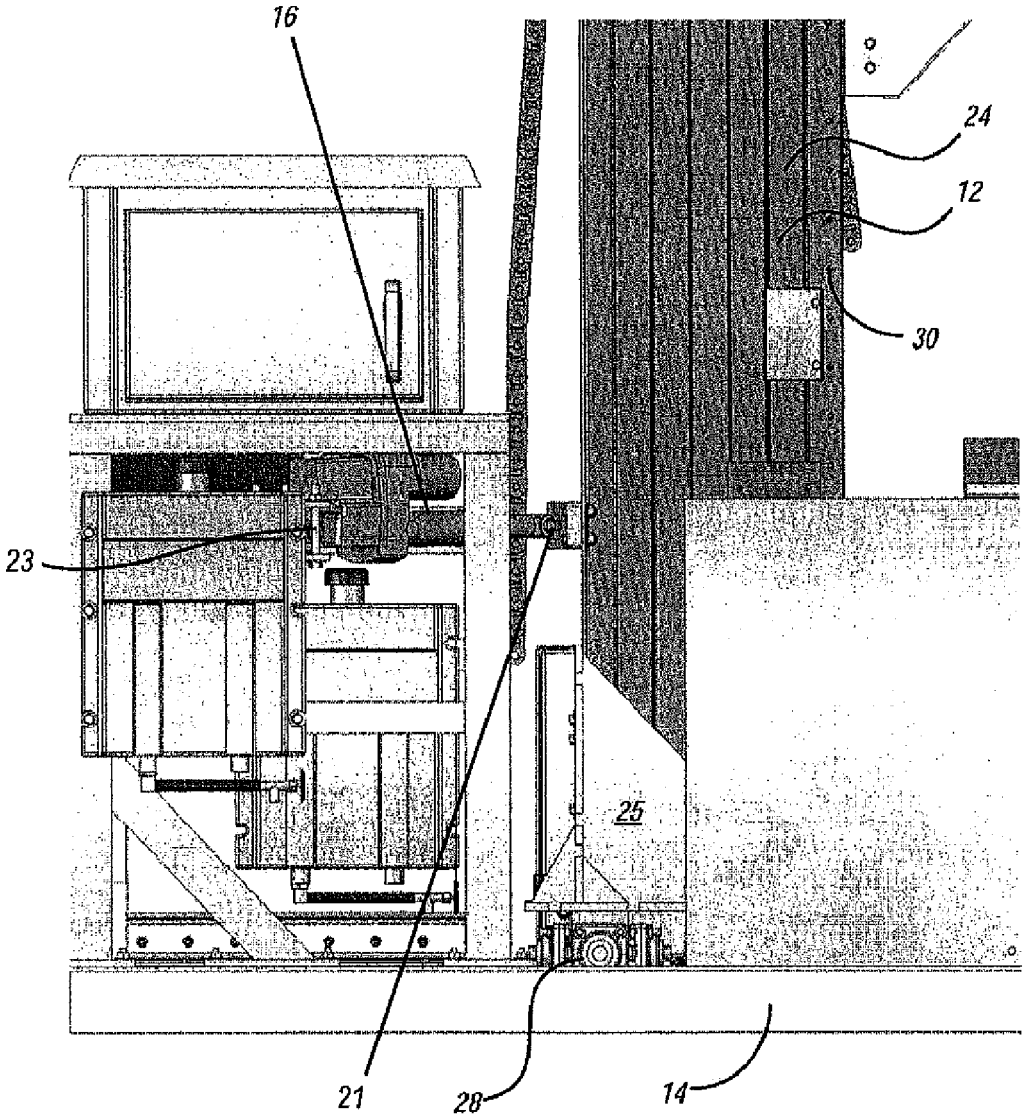
FIG. 6 is a side elevational view of a portion of the platform of FIG. 1 showing more closely the U-joint and mast actuators.
Figure 7:
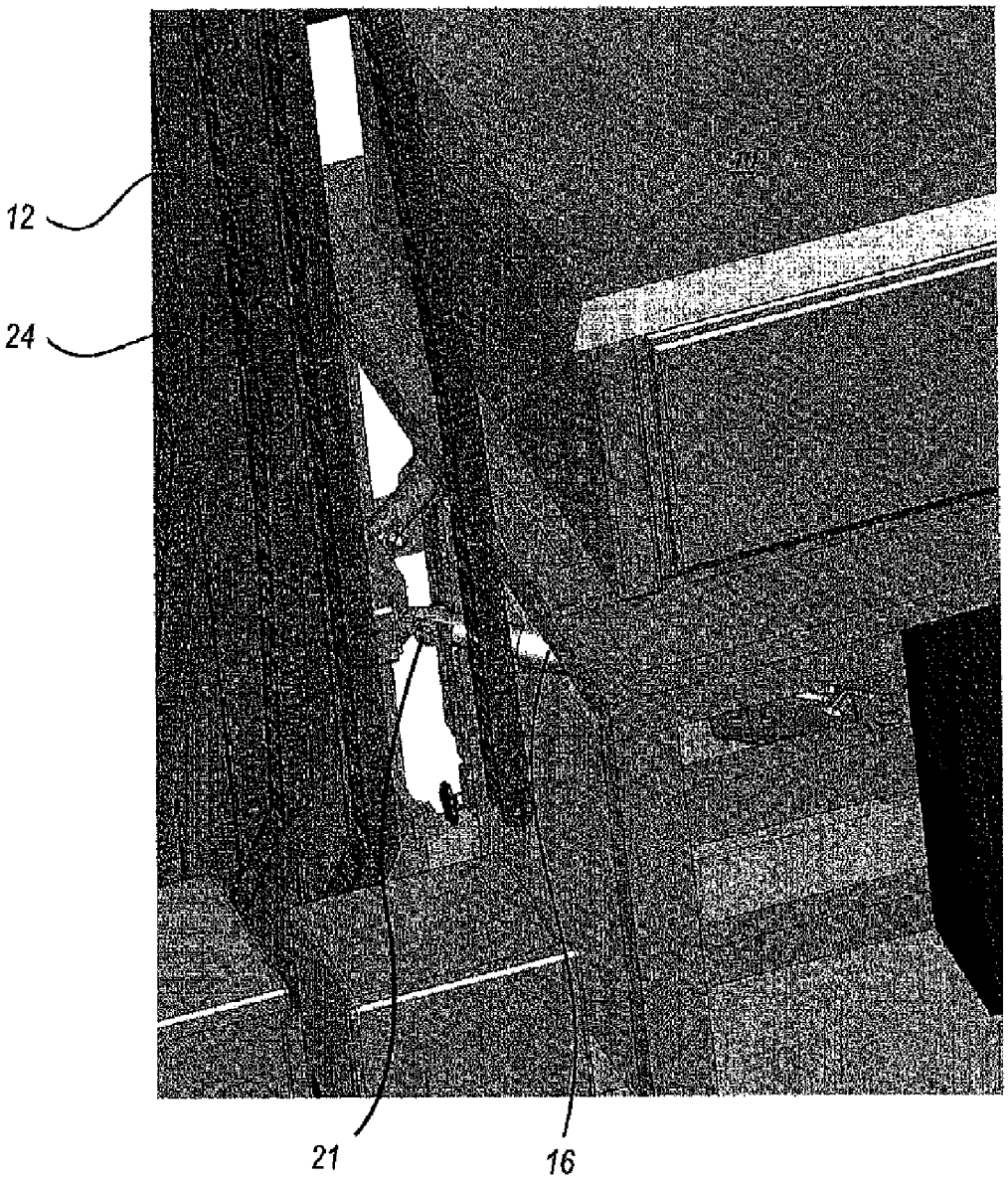
FIG. 7 is a perspective view of a portion of the platform of FIG. 1 showing more closely coupling of the mast actuators to the mast.
Figure 8:
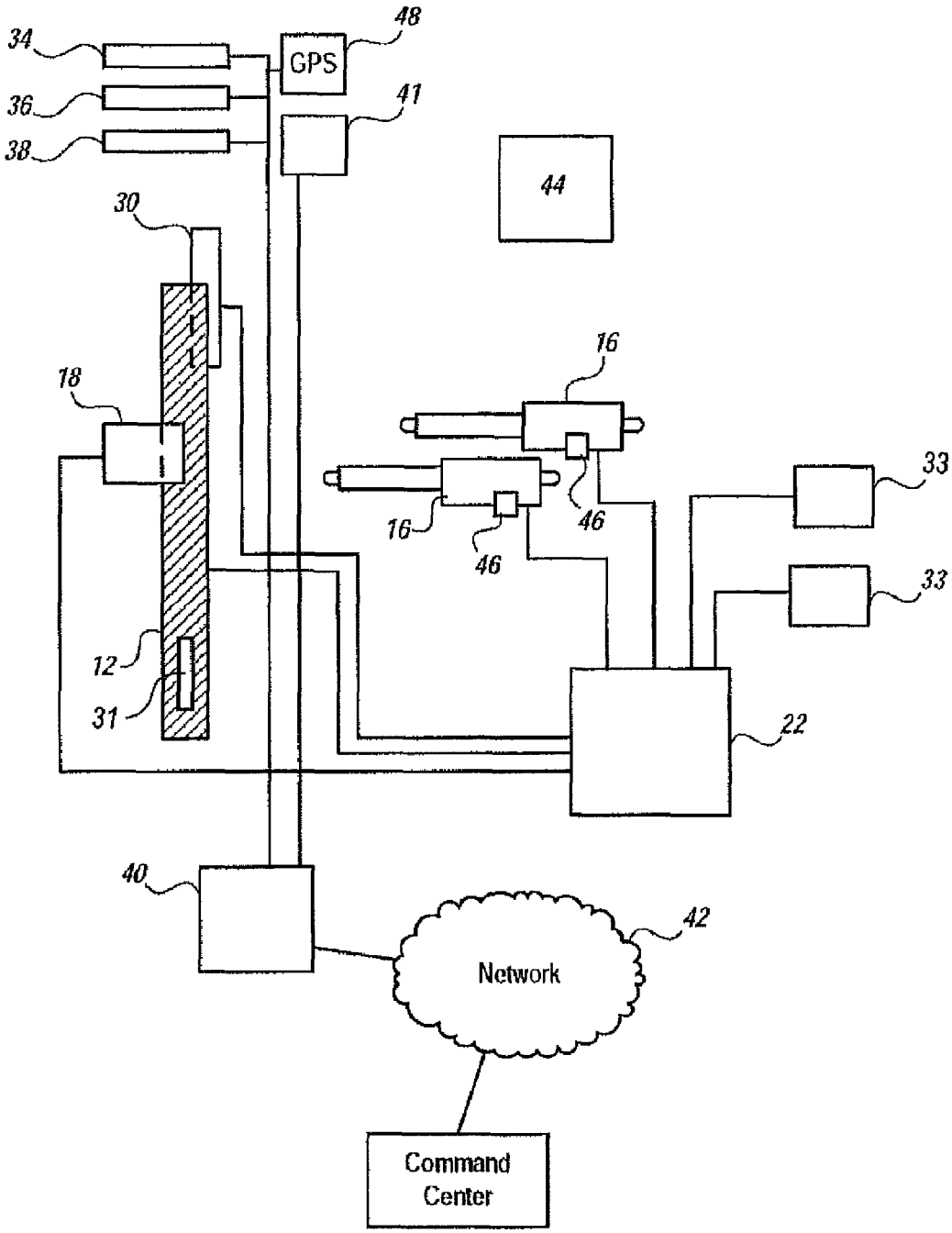
FIG. 8 is a schematic view of certain electrical components of the platform of FIG. 1.

FIG. 1 shows a perspective view of a platform 10 according to an embodiment of the invention. Platform 10 includes an extendable mast 12 connected to a skid 14 via a linkage or coupling mechanism 28 that allows pivoting of the mast 12 with respect to the skid 14, and preferably does not permit rotation of the mast 12 with respect to the skid 14 or portions of itself. At least two actuators 16 are connected to the mast shown in FIG. 1. The platform includes at least one inclination sensor 18 which is preferably mounted or connected to mast 12 but may be mounted or connected to platform 10 as otherwise desired. (see FIG. 8). At least one detection sensor 20 is connected to the mast 12 for detecting presence of an object. Circuitry 22 (see FIG. 8) receives information from the inclination sensor(s) 18 and can automatically control the actuators 16, or control them with human intervention, to orient the mast 12 substantially vertically.

The mast 12 is preferably an extendable material lift that is adapted to bear a load of several hundred pounds. The mast 12 is preferably a mast supplied by JLG Industries, Inc. of McConnellsburg, Pa., having model number JLG 20AM, 25AM or 30AM. The mast 12 preferably has adjacent extending sections 24 rather than concentric sections. Among other things, the adjacent sections 24 can allow mounting of brackets 26 or other structure for bearing the sensors 20 without substantially increasing the overall height profile of the mast 12 in stowed position. Preferably, the mast 12 is constrained not to rotate with respect to skid 14 or itself. The skid 14, brackets 26, and other components are preferably made of Aluminum 6061 members, but may be made of other aluminum, steel, or other desirable materials. The mast 12 is preferably designed as a stand-alone/non guyed and as a self-guyed stabilized vertical portable extending/retracting structure. In the transport mode, the mast 12 is preferably stowed in the horizontal configuration to minimize the height envelope of platform 10. For deployment, the mast 12 can be positioned to vertical via a self-plumbing design disclosed below for use in a maximum terrain slope of preferably 8 degrees in two (2) axes. Preferably, the mast 12 features a minimum extended height (un-guyed) from grade of 18 feet on an unmodified host truck, and a sensor package weight of at least 350 lbs. The mast 12 can preferably be extended or retracted in a wind up to 35 mph, and can survive in a wind speed of 80 mph.

The mast 12 is preferably connected to the skid 14 so that its weight is borne by a universal joint or other coupling mechanism 28 that preferably does not allow rotation of the mast 12 relative to the skid 14 but does allow pivoting of mast 12 relative to the skid 14 with two degrees of rotational freedom. The coupling mechanism 28 is robust, and it allows the mast 12 to be pivoted relative to the skid 14 by the actuators 16 but without undue play, even in a stiff wind or when the mast 12 is subject to other stress or forces. It is also preferable that the coupling mechanism 28 does not allow substantial vertical or horizontal translation of the mast 12 relative to the skid 14. Most preferably, the mast 12 is constrained relative to the skid 14 in all but 2 of the six degrees of freedom in that the mast 12 can pivot in two degrees of freedom relative to the skid 14 but not rotate relative to the skid 14 or itself.

The mast 12 is also coupled to the skid 14 or intervening structure using two or more actuators 16. Preferably, the actuators 16 are oriented at 90 degrees relative to each other and substantially horizontally relative to the skid. Such an orientation assists in stability of the mast 12 and simplifies the geometry of controlling the mast 12 orientation; however, any number of actuators 16 at any desired angles or orientation relative to each other or the mast 12 could be used. The actuators 16 are preferably mechanically elongatable struts and more preferably ball or machine screw mechanisms which can extend or retract and thus be used to pivot the mast 12 relative to the skid 14 for automatic or manual plumbing. The actuators 16 could, if desired, be hydraulically powered or of other structure, construction or mode of operation. Preferably the actuators are 1500 pound actuators supplied by Duff-Norton of Charlotte, N.C., having model number LSPD 6415-6.

Electric actuators 16 are preferred because of their precision and the lack of hydraulic hoses that are needed for hydraulic cylinders that may limit the mobility of the hydraulic cylinders, though hydraulic actuators could be used. The actuators 16 preferably have a spherical ball joint 21 mounted to their ends adjacent to the mast 12 to allow for the rotation that occurs during leveling. However, the base end of each actuator 16 preferably features a coupler structure 23 that allows for the necessary movement of the actuators 16 but will not arbitrarily rotate as it would there were a spherical joint at both ends.

The skid 14 is preferably of a type and size that allows it together with the platform 10 to be stowed in a pickup truck bed or other desirable location. The mast 12 preferably features in its top-most extending section, an acme screw or other extension mechanism 30 for extending the sensors 20 to an elevation that allows their use from the back of a pickup truck or other vehicle, without necessarily extending the mast 12 to its full vertical extension. Preferably, the extending section 30 is a screw drive system. The screw drive preferably includes an acme screw mounted in the center of the last or upper mast 12 section, a motor, chain, and an alignment structure 25 that ensures true alignment and precision operation of sensors 20 as the extending section 30 extends and retracts along the acme screw. Such a screw drive system allows the deployment of the mast 12 from transport mode to full operational capability without extending the entire mast 12. Preferably the sensors 20 are mounted via bracket or as otherwise desired to the last or upper section of the mast 12 and able extend and retract separately from the other parts of the mast 12 because when deployed on the back of the truck instead of a trailer, the operator can then extend the sensors 20 and have 360 degree coverage of the target area without extending the mast 12 and risking an overturn moment. The mast 12 preferably does not require power to remain deployed nor preferably does it require power to retract with its backup manual capability.

The platform 10 includes one or more sensors 18 such as conventional inclinometers, which are preferably connected to the mast 12, for generating information related to inclination or orientation of the mast 12 relative to vertical. Sensor or sensors 18 are preferably in the form of TAD II Threshold Angle Detectors from Spectron Glass and Electronics, Inc. of Hauppague, N.Y. Output from the sensor or sensors 18 is preferably employed by control circuitry 22 to control the actuators 16 for automatic plumbing of the mast 12. Preferably, control circuitry can be in the form of a programmable logic controller such as Model Number V120-22-UN2, known as "Graphic Operator Panel and Programmable Logic Controller," supplied by Unitronics of Airport City, Israel. Output from the sensor or sensors 18 can also drive visual indicators 31 (see FIG. 8) so that the mast 12 can be plumbed manually by controlling the actuators 16 manually such as by using toggle switches 33 or other manually controlled circuits in accordance with readings on the visual indicators 31.

One or more brackets 26 preferably connects to the mast 12 or the extension mechanism 30 connected to the mast 12 for bearing one or more sensors 20. In one embodiment, sensors 20 can include a ground-detecting or other radar 34, infrared and/or other thermal or optical sensors 36, and laser detection and/or indication 38 mechanisms. Other sensors can be used, and not all these need be used.

According to one embodiment, the signals from the ground-detecting radar 34 can automatically be employed by sensor image/control circuitry 40 (see FIG. 8) to slew or train the infrared or optical detector(s) 36 or laser devices 38 or other sensors or designators to a target sensed by the radar 34, such as by using servos or other sensor orientation circuitry 41 controlled by control circuitry 40. Images and/or other data from the radar 34 and/or thermal/optical sensors 36 can be conveyed via wireless or other network 42 (see FIG. 8) to a command center, or can be monitored at the platform 10, to identify and/or classify the object and, if desired, train sensors 20 and/or designate or paint the object with a laser or other designator 38 which can operate in a visual or non-visual wave length.

Stability of the mast 12, even in a strong wind, is necessary to allow these sensors to remain trained on the object. This consideration gives rise to the universal joint 28 and/or other robust connection of the mast 12 to the skid 14, and preferably, the non-rotation of the mast 12 relative to the skid 14 or portions of itself, as well as non-translation of the mast 12 relative to skid 14 either vertically or horizontally.

The platform 10 preferably contains a stand-alone power supply 44 such as a diesel or gasoline reciprocating engine with alternator or generator and/or batteries, solar, any combination, or any other desired power supply. Power can also be supplied externally.

Certain embodiments of the platforms can also include GPS circuitry 48 for automatically sensing and reporting geographical position of the platform so that nodes in a wireless network formed of such platforms can be coordinated precisely to other mapping of the geographical terrain for triangulation and thus establishing a geographical position of detected objects or otherwise. A preferred GPS unit is supplied by Hemisphere GPS, Calgary, Alberta, Canada as model number V100 Crescent Series GPS Compass.

Platform 10 according to one embodiment provides a fully integrated platform including sensors, targeting, tracking, Command and Control (C2), communications and operational components. The platform 10 provides interoperability between all systems via a user interface so that an operator is able to switch between system components during use from a single main Graphical User Interface (GUI). The platform 10 can provide an intuitive interface that allows an operator to switch between various sensors 20 and other equipment such as day camera, night camera, laser rangefinder, laser designator, GPS receiver, support cameras, recording, viewing displays (C2 interface) for efficient integrated operations. The system is designed and compliant with Internet Protocol (IP) network connectivity via an Ethernet interface, and is compliant with applicable Department of Defense standards.

Platform 10 according to this embodiment provides, in near real time, radar targets data over IP network connectivity to the Common Operating Picture (COP) and can simultaneously display sensor information (display of coordinates in Universal Transverse Mercator (UTM), Military Grid Reference System (MGRS), Grid, Latitude/Longitude, Geo References, bearings, distances, reference positions of moving subjects as tracking information on any map background at ground scale. The platform 10 provides the capability of combining live sensor data overlaid upon National Geospatial-Intelligence Agency (NGA) format maps using software capable of utilizing geo-coordinates from a Global Position System (GPS) device to register and calibrate the map display relative to the operational location of the mobile surveillance system.

Platform 10 according to this embodiment can provide interchangeable short range, mid range, and long range sensor 20 suites (units) of integrated day, night, laser rangefinder, and related sensor system components. Each of the three interchangeable sensor 20 packages (short, mid, and long range) can be mounted on the head of the mast 12 or extension mechanism 30, allowing rapid removal and deployment of any of the three (short, mid and long range) sensor package units to the mast 12.

Platform 10 according to this embodiment provides surveillance and target acquisition using a portable radar system. The Ground Surveillance Radar (GSR) system 34 is a low power (less than 4 Watts transmitting power), weighing a maximum of 80 lbs fully integrated, designed and ruggedized for mobility and is operationally ready within 2-5 minutes upon power up. The radar system performance is covered by a B-2 Specification, S333-308001.

Platform 10 according to this embodiment also provides real time output of sensors 20 or other sensor information for IP based network distribution. The system utilizes hardware and software interoperability to accommodate Input and Output (I/O) and accepts input from other sensor systems in order to "fuse" data for display on terrain maps providing "C2" situational awareness within the region of operation. The system allows operators to correct for nuisance alarm sources by adjusting system environmental settings or utilizing filtering or "masking" capabilities.

Platform 10 according to this embodiment provides for operation and viewing from a laptop display and is fully interoperable with IP based network communications for the near real time distribution of radar sensor information to the COP. The system supports communications (alerts and telemetry from moving targets) over parallel, RS-232, RS-422, Ethernet and USB connections. The system supports Extensible Markup Language (XML) 2.0 for use with Geospatial mapping systems. The system is capable of real time display of movements and activities (within software) for multiple sector selection sets, zoom modes providing 1.5 by 1.5 km windows of viewing upon acquisition, audio classifications at all ranges, auto target classification during surveillance, auto tracking in audio mode, target data logging, and variable range scale selection support for 2 display screens (dual screen graphics card).

Platform 10 is also unique in its "transport to transmit" time. It can be transported with all equipment mounted in the deployment position. This is an important feature because of the ease of deployment. It is achieved through a number of the features disclosed in this document. The self-plumbing/leveling system is capable of a manual and automatic function. Control circuitry 22 in the form of a Programmable Logic Controller (PLC) is used in this embodiment. The PLC makes individual adjustments to the actuators 16 allowing the following three (3) modes of operation to adjust the orientation of the mast 12:

(1) Manual Mode: Operator views a level indicator 31 and uses two toggle switches 33 to adjust the mast 12 to the plumb or true vertical position.

(2) Home Mode: Automatically positions the mast 12 to the precise location each time to ensure the sensor 20 payload nests on the fixed cradle brackets to provide necessary support to the sensor payload during transport. The Programmable Logic Controller (PLC) measures feedback from potentiometers 46 mounted inside or otherwise connected to the actuators 16 to locate the mast 12 to the same home position each time. The importance of this is to nest the sensors in transport cradles without removing during transport. Potentiometers 46 when used in connection with the actuators 20 can provide precise location of the actuators 20 to the PLC. This is preferably but not necessarily achieved through regulated voltage resistance.

(3) Auto Leveling Mode: Designed to provide the operator auto plumbing of the mast 12 before and during deployment. The mast 12 should preferably only be deployed if it is in the plumb position. The PLC measures feedback from inclinometer(s) 18 that are mounted on the mast 12 to ensure the mast 12 remains in the plumb position even if the skid 14 were to change orientation intentionally or accidentally. The PLC information is filtered or conditioned to take into account anomalies or transients such as wind gusts; the administrator can have at least partial control of such filtering or conditioning, and/or it can be preset.

The foregoing description of exemplary embodiments of the invention is presented for purposes of illustration and description and is not intended to be exhaustive or to limit the invention to the precise forms, structures or techniques disclosed. Modifications and variations to those forms, structures and techniques are possible without departing from the scope or spirit of the above disclosure and the following claims. Alternative embodiments will become apparent to those skilled in the art to which the present invention pertains without departing from its spirit and scope.

What is claimed is:

1. A detection platform comprising:

a mast in pivotal connection with a skid wherein the pivotal connection constrains the mast to two degrees of rotational freedom relative to the skid;

at least one detection device coupled to a portion of the mast;

at least two actuators, wherein the actuators are coupled to the mast and can adjust the mast to within the two degrees of rotational freedom to a substantially vertical position when said skid is positioned on terrain having a maximum slope of up to about (eight) 8 degrees; and at least one inclination sensor to generate information related to the orientation of the mast.

2. The detection platform of claim 1, wherein the mast comprises a plurality of mast sections, wherein a first mast section is coupled to the skid and a second mast section provides the portion of the mast to which the detection device is coupled.

3. The detection platform of claim 2, wherein the second mast section further comprises an extension mechanism that permits vertical movement of the detection devices within the second mast section.

4. The detection platform of claim 3, wherein the extension mechanism is a screw drive system.

5. The detection platform of claim 1, wherein the pivotal connection is a universal joint.

6. The detection platform of claim 1, wherein the actuators are oriented at 90 degrees relative to each other and substantially horizontal relative to the skid.

7. The detection platform of claim 1, wherein the actuators comprise a base end portion and a mast end portion, wherein the base end portion comprises an attachment site sufficient to allow pivotal movement and the mast end portion comprises an attachment site sufficient to allow rotational movement.

8. The detection platform of claim 7, wherein the attachment site of the mast end portion comprises a spherical ball joint.

9. The detection platform of claim 1, further comprising a visual indicator and at least one operating switch, wherein the visual indicator provides a visual display of the information generated by the inclination sensor and the operating switch permits manual control of the actuators.

10. The detection platform of claim 1, further comprising a control circuitry, wherein the control circuitry receives the information from the inclination sensor and automatically drives the actuators to pivot the mast to a first predetermined position.

11. The detection platform of claim 10, wherein the control circuitry is a programmable logic controller.

12. The detection platform of claim 10 wherein the first predetermined position is vertical.

13. The detection platform of claim 10, further comprising potentiometers, wherein the potentiometers provide information about the location of the actuators and wherein the control circuitry uses the information from the potentiometers to automatically drive the actuators to pivot the mast to a second predetermined position.

14. The detection platform of claim 13, wherein the second predetermined position facilitates transport of the detection devices.

15. A detection platform comprising:

a mast in pivotal connection with a skid, wherein the pivotal connection constrains the mast to two degrees of rotational freedom relative to the skid;

at least two actuators, wherein the actuators are coupled to the mast and operate to adjust the mast within the two degrees of rotational freedom to a substantially vertical position when said skid is positioned on terrain having a maximum slope of up to about (eight) 8 degrees;

at least two potentiometers, wherein one or more potentiometers is associated with each actuator and wherein the potentiometers provide information concerning the position of the actuators; and control circuitry, wherein the control circuitry receives information from the potentiometers and uses the information to automatically drive the actuators to pivot the mast to a position that facilitates transport of the detection devices.

16. A leveling system for a detection platform comprising:

a mast in pivotal connection with a skid, wherein the pivotal connection constrains the mast to two degrees of rotational freedom relative to the skid;

at least one detection device coupled to a portion of the mast;

at least two actuators, wherein the actuators are coupled to the mast and operate to adjust the mast within the two degrees of rotational freedom to a substantially vertical position when said skid is positioned on terrain having a maximum slope of up to about (eight) 8 degrees;

at least one inclination sensor to generate information related to the orientation of the mast;

at least two potentiometers, wherein one or more potentiometers are associated with each actuator and wherein the potentiometers provide information concerning the position of the actuators;

a visual indicator, wherein the visual indicator provides a visual display of the information generated by the inclination sensors;

at least one operating switch, wherein the operating switch allows manual control of one or more of the actuators to orient the mast;

control circuitry, wherein the control circuitry receives the information from the inclination sensors or the potentiometers and uses the information to automatically drive the actuators;

wherein the leveling system comprises a manual mode and a home mode;

wherein the manual mode allows for manual orientation of the mast through use of the visual indicator and the operating switch;

wherein the home mode uses the potentiometers and control circuitry to automatically drive the actuators to pivot the mast.

* * * * *